United States Patent [19]

Parker

[11] 3,967,912

[45] July 6, 1976

[54] PAVER FEED CONTROL

[76] Inventor: Jimmy L. Parker, 19909 Filbert Drive, Bothell, Wash. 08011

[22] Filed: Mar. 18, 1974

[21] Appl. No.: 452,056

[52] U.S. Cl. ..... 404/84; 404/108

[51] Int. Cl.[2] ..... E01C 19/00

[58] Field of Search ..... 404/108, 101, 84, 83, 404/118

[56] References Cited

UNITED STATES PATENTS

| | | | |
|---|---|---|---|
| 2,591,502 | 4/1952 | Bohannan | 404/84 |
| 3,015,258 | 1/1962 | Apel | 404/106 |
| 3,396,644 | 8/1968 | Banks | 404/108 X |
| 3,453,939 | 7/1969 | Pollitz | 404/84 |
| 3,537,363 | 11/1970 | Long | 404/108 |
| 3,572,227 | 3/1971 | Poulsen | 404/118 |
| 3,636,832 | 1/1972 | Schrimper | 404/84 |
| 3,678,817 | 7/1972 | Martenson | 404/108 X |
| 3,774,401 | 11/1973 | Allen | 404/84 X |
| R25,275 | 10/1962 | Pollitz | 404/84 |

*Primary Examiner*—Nile C. Byers

*Attorney, Agent, or Firm*—Graybeal, Barnard, Uhlir & Hughes

[57] ABSTRACT

Two feed conveyors and two spreader augers are independently driven, each by its own drive motor. The control means for each feed conveyor includes a sensor at the discharge end of the feed conveyor and means responsive to changes in the level of the paving material at the sensor for proportionally increasing the drive speed of the conveyor as the level drops and proportionally decreasing the drive speed of the conveyor as the level rises. The control means for each auger includes a sensor adjacent the discharge end of the auger and means responsive to changes in the level of the paving material at the sensor for proportionally increasing the drive speed of the auger as the level drops and proportionally decreasing the drive speed of the auger as the level rises.

10 Claims, 13 Drawing Figures

PAVER FEED CONTROL

BACKGROUND OF THE INVENTION

1. Field of the Invention

This invention relates to paving machines, and in particular to the provision of a completely automated paving machine capable of high speed paving over almost any type or condition of subgrade, including when variations in widths are encountered.

2. Description of the Prior Art

The type of paving machine to which this invention relates is generally characterized by a frame which is supported on and is moved forwardly by ground engaging wheels or tracks. The frame supports a hopper into which the paving material is dumped. The paving material is removed from the hopper and moved rearwardly by a pair of endless belt type feed conveyors, one on each side of the machine. The feed conveyors deposit the paving material in a transverse trough containing a pair of laterally extending spreader screws or augers. These augers spread the material out forwardly of a finishing screed which trails the augers. The finishing screed functions to screed and level the paving material.

Finishing machines of the type described are disclosed by the following U.S. Pat. Nos. 2,351,592, granted June 20, 1944 to Harry H. Barber; 2,589,256, granted Mar. 18, 1952, to Harold R. Horning; Re No. 25,275, granted Oct. 30, 1962 to Harold C. Pollitz; 3,453,929, granted July 8, 1969 to Harold C. Pollitz, Vernon L. Schrimper and Louis F. Fairchild; 3,537,363, granted Nov. 3, 1970, to George E. Long and Howard G. Anson; 3,678,817, granted July 25, 1972, to Earl D. Martenson and James J. Gebhardt, Jr.; 3,700,288, granted Oct. 24, 1972, to Donald R. Davin and Gary H. Beckley.

Paving machines of the type described which are known to be in use have feed conveyors and spreader augers which are mechanically coupled together and driven by single drive motors. They include a strike-off gate which is vertically movable and is raised or lowered for the purpose of varying the depth of the material which is deposited on the feed conveyors, to in this manner vary the quantity of material which is delivered from the hopper to the region forwardly of the screed.

Several of the aforementioned patents teach varying the feed rate by varying the drive speed of the feed conveyors and spreader augers. Some of such patents teach driving each feed conveyor and its spreader auger independently of the other feed conveyor and its spreader auger. Pollitz et al U.S. Pat. No. 3,453,939 proposes the use of manually controllable means for varying the speed of each feed conveyor and each spreader auger. Each feed conveyor and each spreader auger has its own hydraulic drive motor. The drive motors are independently controllable so that the drive speed of each feed conveyor can be varied relative to the drive speed of its spreader auger.

Pollitz, U.S. Pat. No. 25,275; Pollitz et al U.S. Pat. No. 3,453,939; Long U.S. Pat. No. 3,537,363 and Martenson et al. U.S. Pat. No. 3,678,817 disclose control systems for the feed conveyors and the spreader augers which include material level sensing units positioned at the sides of the machine, adjacent the outer ends of the augers. In the machines disclosed by Pollitz U.S. Pat. No. 25,275 and Pollitz et al U.S. Pat. No. 3,453,939, the sensors are in the nature of limit switches which sense only the presence of excess material and function to interrupt operation of the feed conveyor and the spreader screw on the side of the machine to which an excess of material has been delivered. Long U.S. Pat. No. 3,537,363 and Martenson et al U.S. Pat. No. 3,678,817 disclose automatic control systems for varying the drive speed of each feed conveyor and its spreader screw in response to changes in the depth of material sensed at the outboard end of a spreader screw.

SUMMARY OF THE INVENTION

Paving machines of the present invention include independently driven, automatically controlled feed conveyors in addition to independently driven, automatically controlled spreader screws or augers.

According to the invention, a separate material level sensor is located adjacent the discharge end of each feed conveyor. Each such sensor measures the level of the paving material below it. Each feed conveyor also includes control means responsive to changes in the level of paving material at the sensor for proportionally increasing the drive speed of the feed conveyor as the level drops and proportionally decreasing the drive speed of such conveyor as the level rises. As in the systems disclosed by Long U.S. Pat. No. 3,537,363 and Martenson et al U.S. Pat. No. 3,678,817 a level sensor is also provided adjacent the outboard end of each spreader auger. However, according to the present invention, the signal generated by each such sensor is used for controlling only the drive speed of the associated spreader auger. Each spreader auger includes means responsive to changes in the level of the paving material at its sensor for proportionally increasing its drive speed as the level drops and proportionally decreasing its drive speed as the level rises.

An advantage of the material feed control system of this invention is that a proper head of paving material is always maintained on the screed regardless of the ground speed of the paver and regardless of variations in depth and/or width requirements of the mat. The feed conveyors automatically adjust to changes in the demand of the augers. The material level on the augers never increases to too high a level and never decreases to too low a level. The augers can speed up or slow down, as necessary, without having a direct effect on the quantity of paving material which is delivered by the feed conveyors to the augers. No adjustment of a control gate is necessary. The human element is essentially completely removed from the material feed portion of the paving operation.

Another more detailed aspect of the present invention is the provision of an improved hydraulic motor drive system for the feed conveyors and the spreader augers, and the provision of an improved control system for such hydraulic motors, both the general concept and details of which are described below in conjunction with the illustrated embodiment.

A further aspect of the invention is the provision of mechanism for slowing down and/or stopping the forward travel of the paving machine if and when the amount of paving material in the hopper drops below a predetermined quantity.

DESCRIPTION OF THE PREFERRED EMBODIMENT

Figure 1:
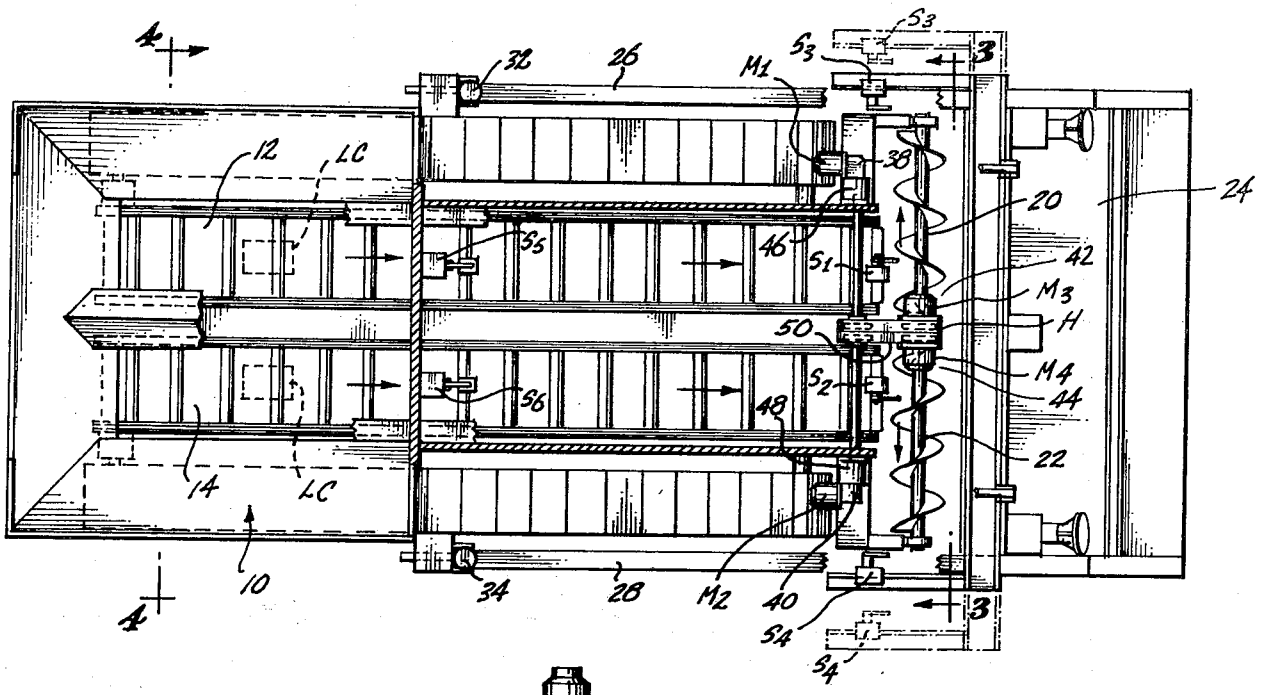
FIG. 1 is a top plan view of a paving machine which incorporates the present invention, such view including broken line showings of screed extenders in their extended positions, with the sensors of the auger drive and control system being mounted on the screed extenders.
Figure 2:
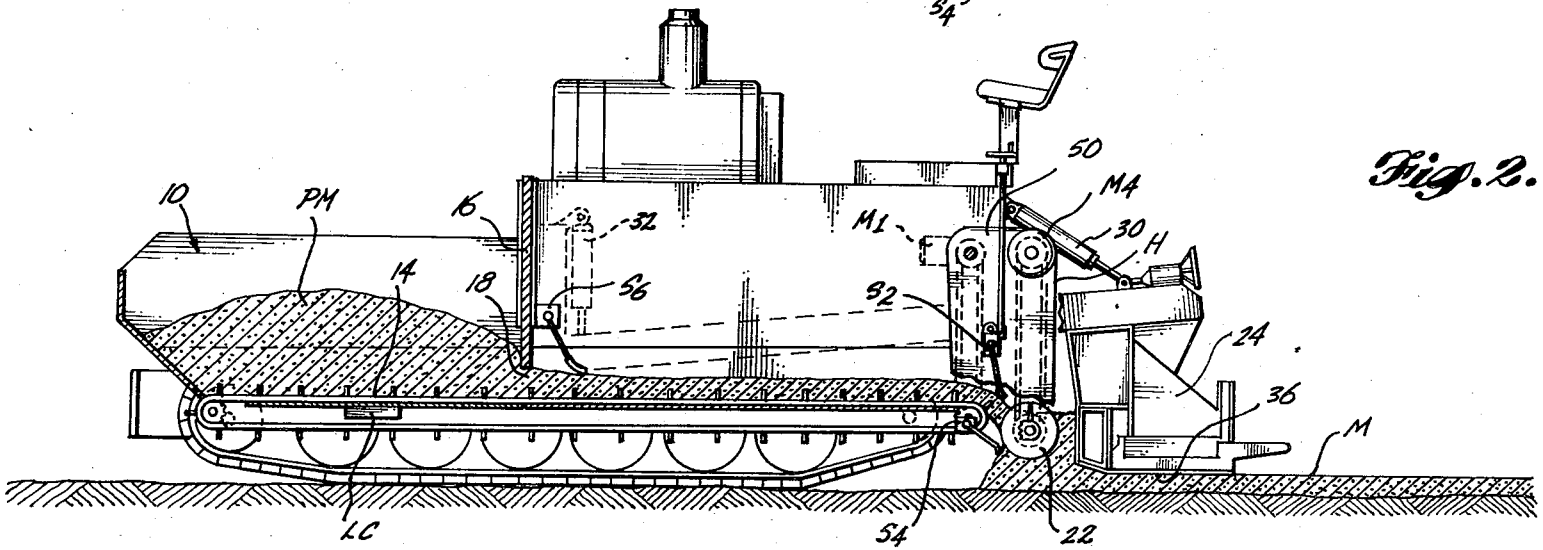
FIG. 2 is a longitudinal sectional view taken through the machine substantially along line 2—2 of FIG. 1.
Figure 3:
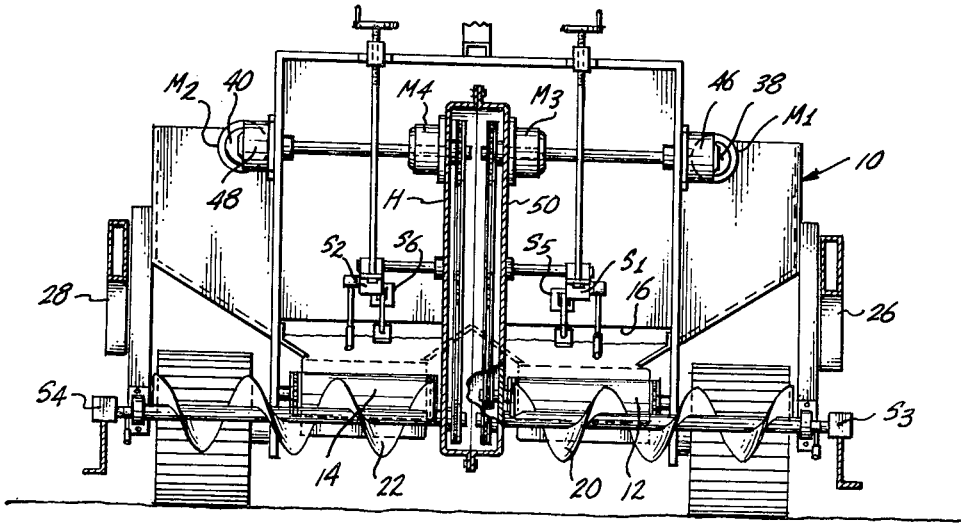
FIG. 3 is a transverse sectional view taken through the auger trough region of the machine, substantially along line 3—3 of FIG. 1.

As shown by FIGS. 1 and 2, asphalt concrete or some other paving material PM is deposited into a hopper 10 located at the forward end of the paving machine. The floor of the hopper 10 is partially defined by the forward portions of the upper flights of a pair of endless belt type feed conveyors 12, 14. A strike-off plate 16 is provided at the downstream end of the hopper 10. The vertical height of the feed opening 18 below plate 16 helps determine the amount of material which leaves the hopper 10 on the feed conveyors 12, 14. The region between the feed opening 18 and the downstream ends of the feed conveyors 12, 14 is usually referred to as the tunnel.

The feed conveyors 12, 14 deposit the paving material PM into a transverse trough in which a pair of spreader screws or augers 20, 22 are located. A leveling screed 24 trails the augers 20, 22 and works or screeds the paving material PM, to bring the fine materials towards the top, and also to level the material PM and form it into a substantially constant thickness mat M. The screed 24 may be supported by a pair of side arms 26, 28 and cylinders 30 at the rear of the machine. The forward ends of the support arms 26, 28 may be raised and lowered by a pair of hydraulic cylinders 32, 34 which are interconnected between a frame portion of the machine and the forward ends of the arms 26, 28. The cylinders 32, 34, 30 are used for controlling the height and attitude of the lower surface 36 of screed 24 which contacts and works the material PM.

The above described features are all old and well known in the art and are disclosed by such prior patents as Pollitz et al U.S. Pat. No. 3,453,939 and Davin et al U.S. Pat. No. 3,700,288.

According to an aspect of the present invention, each feed conveyor 12, 14 includes its own variable speed drive means 38, 40 and each auger 20, 22 includes its own drive means 42, 44. Preferably, each drive means 38, 40, 42, 44 includes a hydraulic motor and may also include a transmission. In the illustrated embodiment the drive means 38 includes a hydraulic motor M1, the output shaft of which is coupled to the rear sprocket shaft of feed conveyor 12 by means of a transmission 46. Drive means 40 includes a hydraulic motor M2, the output shaft of which is coupled to the rear sprocket of feed conveyor 14 by means of a transmission 48. Of course, in some installations, the motors M1, M2 may be directly coupled to the sprocket shafts. Motor M1 is automatically controlled by control apparatus which includes a sensor S1. Motor M2 is automatically controlled by control apparatus which includes a sensor S2.

Figure 4:
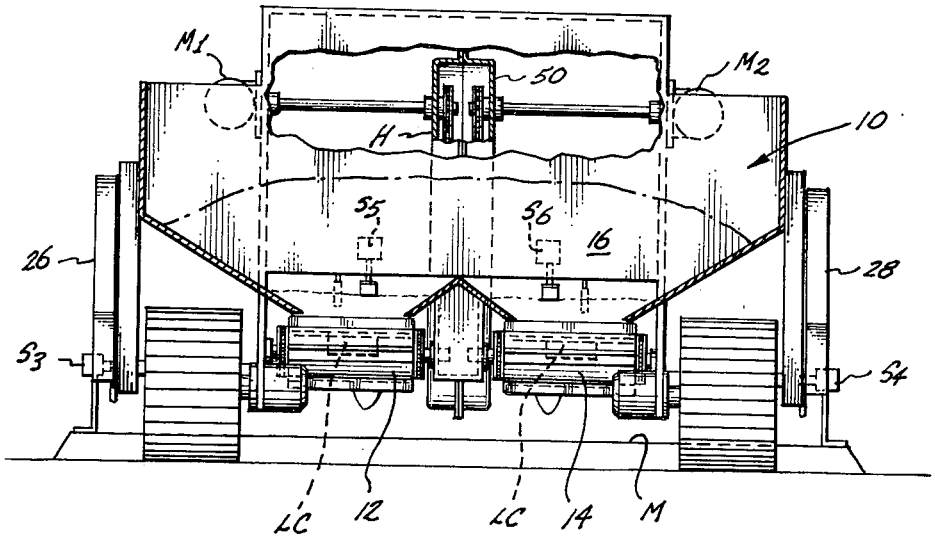
FIG. 4 is a transverse sectional view taken through the hopper, substantially along line 4—4 of FIG. 1.

In the illustrated embodiment, the drive means 42 includes a hydraulic motor M3 which is mounted at the upper end of a chain housing 50. It drives an upper sprocket (FIG. 4) in housing 50 which is connected by a drive chain to a lower sprocket which is secured to the auger 20. In similar fashion, the drive means 44 includes a second hydraulic motor M4 which is connected to the opposite side of the upper part of chain housing 50. It drives an upper drive sprocket which is connected by a drive chain to a lower drive sprocket which is connected to the auger 22. Motor M3 is automatically controlled by control apparatus which includes a sensor S3. Motor M4 is automatically controlled by control apparatus which includes a sensor S4.

Figure 11:
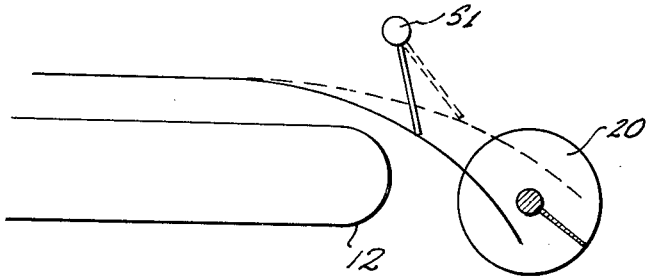
FIG. 11 is a fragmentary side elevational view at the rear end of the left side feed conveyor, showing that the sensor associated with such feed conveyor measures differences in the level of the paving material in a repose region.

The sensors S1, S2 are mounted adjacent the discharge ends of the feed conveyors 12, 14. As best shown by FIG. 11, they detect the level of paving material PM being delivered into the augers 20, 22. Sensors S3, S4 measure the level of the paving material that is delivered to the outer portions of the material trough, i.e. the material maintained forwardly of the screed 24.

According to the present invention, the feed conveyors 12, 14 and the augers 20, 22 are all independently automatically controlled so that a proper amount of paving material is maintained in the trough forwardly of the screed 24 regardless of the surface condition encountered. The control of each of the conveying means 12, 14, 20, 22 is entirely automatic, making it unnecessary for the operator to watch the feed process and then adjust some operation of the machine in response to changes which he sees occur. As a result, it has been found that it has been possible to move the machine forwardly at a faster rate than was possible with a machine lacking such automation.

Figure 10:
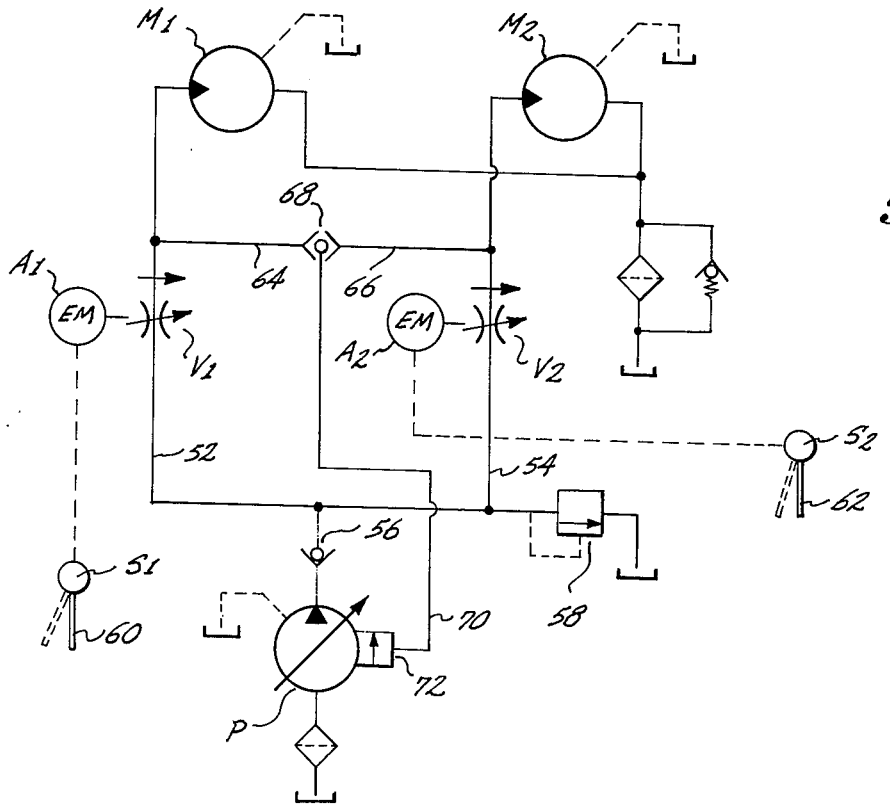
FIG. 10 is a schematic view of the drive and control system for the feed conveyor motors, but also being representative of the drive and control system for the two spreader augers which is essentially identical thereto.

FIG. 10 is a schematic diagram of a preferred embodiment of the drive and control system for the feed conveyors 12, 14. In the preferred embodiment the drive and control system for the augers 20, 22 is essentially identical, so it is not separately shown nor described.

As shown by FIG. 10, a single load sensing pressure compensated piston pump P is used for supplying hydraulic drive fluid through lines 52 and 54 to both feed conveyor drive motors M1, M2. The system is provided with a check valve 56 and a pressure relief valve 58.

The motors M1, M2 may be either high speed, low torque axial piston motors or slow speed, high torque radial piston motors. A speed reduction transmission must be used with the high speed, low torque motors, whereas the low speed, high torque motors may be driven directly coupled to the rear sprocket shafts of the feed conveyors 12, 14.

Motors M1, M2 are flow controlled motors, i.e. the drive speed varies in proportion to the flow rate of the hydraulic fluid which is delivered to them. According to an aspect of the invention, the flow to each motor M1, M2 is independently controlled by a pressure compensated, quick adjustable flow control valve. One valve V1 is located in the delivery line 52 leading from the pump P to the motor M1 and another such valve V2 is located in the delivery line 54 leading from the pump P to the motor M2. An electric servo motor actuator A1 is associated with valve V1 and another such actuator A2 is associated with valve V2.

Each sensor S1, S2 has a depending control arm 60, 62 which is supported to be in the flow path of the paving material PM. Angular movement of an arm 60, (or 62) adjusts the sensors S1 (or S2) and this generates an electrical signal which causes the actuator A1 (or A2) to rotate the control shafts of the valve V1 (or V2) an amount proportional to the degree of movement of the arm 60 (or 62).

The pump P may be a load sensing pressure compensated piston pump, such as the Delavan model PV 325 OR-32004-5, for example. This particular pump is rated at 23.5 gpm, 1800 RPM and has a 3000 psi maximum continuous pressure rating. Some of the fluid downstream of each valve V1, V2 is tapped and by way of lines 64, 66 is brought to a shuttle valve 68 (e.g. a Fluid Power Systems Model 22-1A shuttle valve). The shuttle valve 68 allows the higher of the two metered flow pressures to be delivered by line 70 back to the controller port 72 of pump P.

The flow control valves V1, V2 may each be a Parker Hannifin Manatrol Division, Model PCQ-800-S valve, modified to accept an electric motor actuator. This type of valve has a built-in pressure regulator so that at any given flow setting the flow through the valve will be constant regardless of variations in the pressure drop across the valve.

The sensors S1, S2 may be steering sensors which have been provided with sensor wands or arms 60, 62 which extend radially from the input shaft of the sensor. For example, the steering sensors may be of the type manufactured by Grad-Line, Inc., under U.S. Pat. No. 3,537,363, and marketed under No. PT 6520-023-001. The electric actuators A1, A2 for the valves V1, V2 may be actuators of the type made by Grad-Line, Inc., and marketed under No. A420, PT NO6522-087-001 (also known as the Grad-Line 180° Electric Servo-motor Actuator).

As previously mentioned, in the preferred embodiment a second pump P of the type described is used for driving the motors M3, M4. Such motors are basically like motors M1, M2 and are controlled by valves like valves V1, V2. Such valves are controlled by actuators like actuators A1, A2 which receive signals from the sensors S3, S4. The sensors S3, S4 are essentially like sensors S1, S2.

The operation of the feed apparatus of this invention will now be described. Let it be assumed that the paving machine is being driven forwardly, the two augers 20, 22 are being driven at the same speed for the purpose of spreading the paving material PM which is delivered to them laterally outwardly of the machine across the front end of the screed 24, and the feed conveyors 12, 14 are being driven at a speed sufficient to deliver the proper amount of paving material PM into the auger trough. The height of the opening 18, the width of each feed conveyor 12, 14, and the drive speed of each conveyor 12, 14 determines the feed rate of the material into the auger trough. Since the height of the opening 18 and the width of the feed conveyors 12, 14 are constants, the feed rate of each conveyor 12, 14 can only be changed by changing the drive speed of such feed conveyor. As will be apparent, any change in the delivery rate will be immediately noticed at the discharge end of the feed conveyor 12 (or 14). This is not true in systems wherein the strike-off panel or gate 16 is adjusted vertically for the purpose of changing the flow rate by adjusting the vertical height of the feed opening 18. With any such adjustment it takes time for the new depth of material to reach the discharge end of the feed conveyor, during which time the flow rate remains unchanged.

As a recap, flow from the pump P is metered by the pressure compensated flow control valves V1, V2 which are controlled by the electric servo motors A1, A2 to cause the hydraulic motors to turn at the desired speed. The pressure in the lines between the hydraulic motors M1, M2 and the flow control valves V1, V2 is that which is induced by the resistance to the metered flow. The pressure in the lines between the flow control valves V1, V2 and the pump P will be 150 psi above the higher of the two load induced pressures downstream of the flow control valves V1, V2. This happens as a result of the shuttle valve 68 allowing the higher of the two metered flow pressures to act on the load sensing pump controller. The pump will deliver as much flow as is necessary to maintain a pressure 150 psi higher that the pressure sensed at the controller port. Therefore, when the two flow control valves V1, V2 are shut off and the pressure downstream of them drops to 0 the pressure at the outlet of the pump is 150 psi and the pump delivery is 0 since there is no demand. When the pressure downstream of one flow control is 1000 psi and 2000 psi in the other, the pressure at the pump outlet will be 2150 psi and the delivery will be the sum of the two metered flows. The very least pressure drop across the flow control valves V1, V2 will be 150 psi, satisfying the required minimum of 100 psi to operate the regulating spool that is in them. The relief valve 58 is used only to limit the maximum pressure of the system to a value compatable with the components used.

The primary benefit of this design is that it is efficient. The pressure drop across the flow control valves V1, V2 is only 150 psi when the induced pressures are the same regardless of what the induced pressure is. Often systems with two or more motors running in parallel from a single variable flow source are inefficient. This is due to the need to cause the outlet pressure of the pump to be set for as high as would be required for a "worst condition". The difference between worst condition pressure and the induced pressure, or the pressure drop across the flow regulating valves multiplied by the flow through these valves gives an energy loss value. This can be high when light load conditions cause low induced pressures at the motors.

All four motors could be driven by one pump in my system with only the difference between the highest induced pressure and the others leading to inefficiencies that would be beyond the losses that are inescapable such as motor, pump and line losses and minimum drop losses across the flow controls required for regulation. In systems with priority type bypass regulators operating in series to split controlled flows from a fixed flow rate pump, the 100 psi regulation pressure mentioned above must be multiplied by the number of valves in series. This kind of circuit is often seen as the solution to our kind of application and would be likely to generate considerably more heat and never less.

FIGS. 5 – 9 are schematics of the left side of the machine. In these views the auger 20 is rotated inwardly 90° so as to appear as an extension of the feed conveyor 12.

Figure 5:
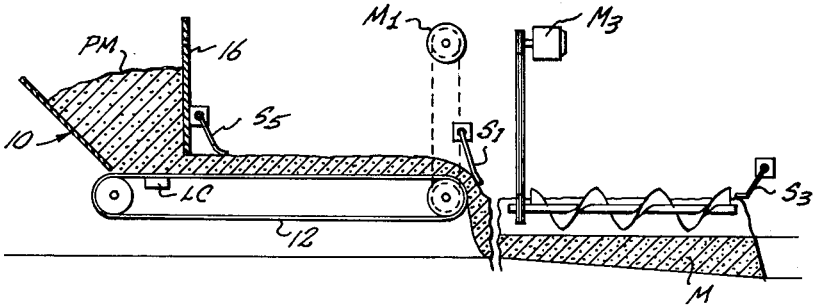
FIGS. 5 – 9 are operational schematic views of the feed and spreader apparatus for the left half of the machine, such views presenting the left side auger rotated 90° from its actual position, so as to appear as an extension of its feed conveyor.

Referring to FIG. 5, let it be assumed that the lower grade (the grade of the ground surface being paved) quickly changes from a flat surface to a crowned surface, i.e., to a surface which slopes downwardly as it extends from the inner end to the outer end of the auger 20. The level of paving material below sensor S3 will immediately drop. When this happens the control arm of sensor S3 moves with the material and generates an electric signal which is proportional to the amount of movement. This electric signal causes a corresponding adjustment in the control valve (not shown by like valves V1, V2), to increase the flow of hydraulic fluid to motor M3 so that the motor M3 will rotate faster and drive auger 20 faster. Hence, auger 20 will deliver paving material PM at a faster rate to the outboard end of the auger 20.

The change in the level of the material below sensor S3 almost instanteously changes the drive speed of motor M3.

The faster travel of auger 20 causes a faster movement of paving material PM away from below sensor S1. As a result, the level of material below sensor S1 drops and the sensor arm swings downwardly an amount proportional to the drop in level. This movement of the sensor arms causes the sensor S1 to generate an electric signal which is proportional to the drop in level. This electric signal is transmitted to the actuator A1, causing it to open valve V1 so that additional hydraulic fluid will be delivered to the motor M1. This change in the drive speed of motor M1, and hence the drive speed of feed conveyor 12 and the feed rate of the paving material PM by feed conveyor 12, also occurs almost instanteously.

Thus, very soon after the level of material at the inboard end of the auger 20 drops because the auger 20 is being rotated faster to increase the rate of delivery of paving material PM to the outboard end of auger 20, the feed conveyor 12 starts to run faster so that the paving material PM is delivered to the auger 20 at a faster rate. As previously mentioned, since the feed rate of the paving material PM by the feed conveyor 12 is not dependent on a change in height of the feed opening 18, but rather is dependent only on the drive speed of feed conveyor 12, an increase in the drive speed of conveyor 12 immediately results in an increase in the delivery rate of the paving material PM.

Figure 6:
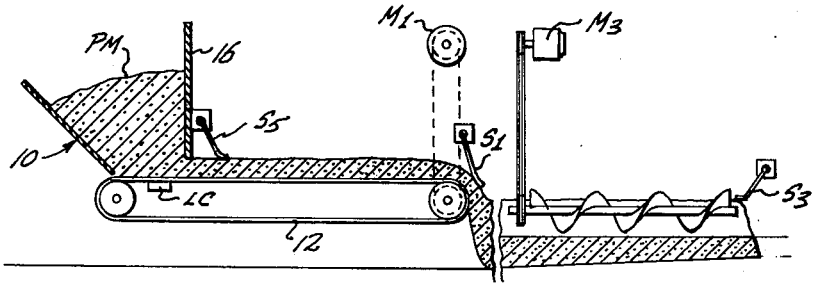

Referring to FIG. 6, let it be assumed that the grade of surface being paved makes an abrupt change under auger 20 so that instead of sloping downwardly from the inboard to the outboard end of the auger it now slopes upwardly. Less material is now needed at the outboard end of auger 20. Hence, the level of material PM under sensor S3 will rise and cause sensor S3 to slow down motor M3. However, sensor S1 will detect a greater demand for material at the inboard end of the auger 20 and will control motor M1 so that it will feed paving material to the inboard end of auger 20 at the rate necessary to meet such greater demand.

Figure 7:
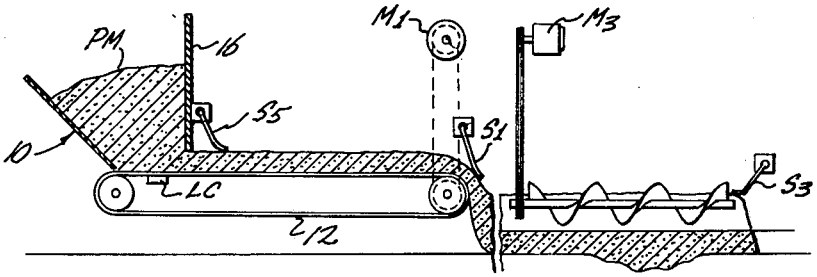
Figure 8:
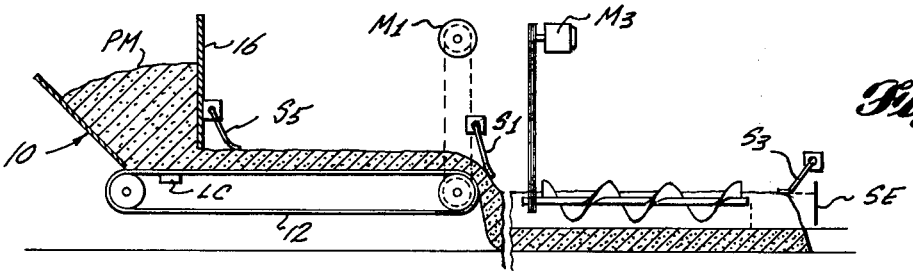

FIG. 7 shows a depression D in the lower grade at a location between the ends of auger 20. This depression will cause the level of material to drop at the inboard end of the auger 20. The drop in level will be sensed by sensor S1, causing it to generate a signal which will speed up motor M1 and increase the feed rate to the inboard end of auger 20 before the depression D can drain a portion of the auger and produce a thin area in the mat.

According to an aspect of the invention, if screed extenders SE are used, the sensors S3, S4 are mounted onto the screed extenders SE so that they will move outwardly when the extenders are moved outwardly. By way of example, screed extenders are disclosed by U.S. Pat. No. 3,109,351, issued on Nov. 5, 1963, to M. J. Dunn, and by U.S. Pat. No. 3,288,041 issued Nov. 29, 1966 to Jack D. Layton. As will be apparent, outward movement of a screed extender SE will cause a decrease in the level of paving material below the sensor S3, causing it to send a signal that will increase the drive speed of motor M3, and hence the delivery rate of auger 20. As in the situation illustrated by FIG. 5, the increased delivery rate of material by the auger 20 will momentarily lower the level at the inboard end of the auger 20, causing movement of sensor S1 and the sending of a signal by it which will increase the drive speed of motor M1 and hence the feed rate of feed conveyor 12.

Figure 9:
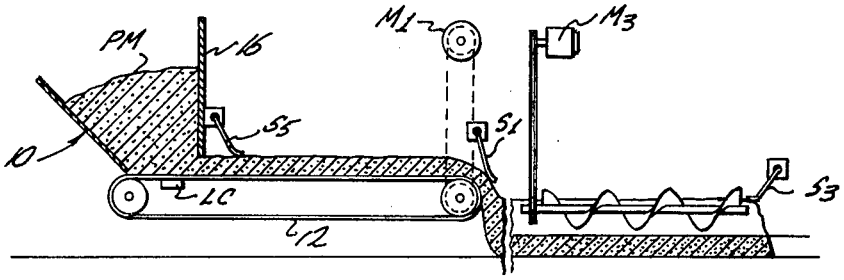

FIG. 9 shows a situation where the lower grade is parallel to the upper grade (i.e., the upper surface of the mat). Under this condition, the drive speed of the motor M1 can be constant and the drive speed of motor M3 can be constant. If this condition were to always exist, the feed conveyor 12 and the auger 20 could be coupled together and drive together, such as is taught by the aforementioned U.S. Pat. Nos. 3,537,363 and 3,678,817. However, this condition does not always exist, so that is why I have provided independent drive means for each feed conveyor 12, 14, independent drive means for each auger 20, 22 and automatic control means which will quickly and automatically vary the drive of each one of these feed components, as necessary, to meet the varying conditions of the surface being paved.

Figure 12:
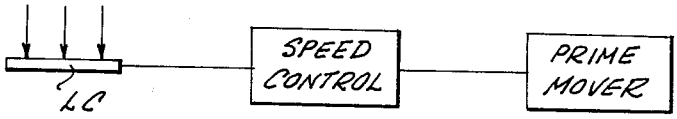
FIG. 12 is a block diagram of a system for slowing down the drive motor in response to the level of paving material in the hopper becoming low.

Another aspect of the invention involves the association of a sensor with each side of the hopper. Preferably, each such sensor is in the form of a load cell LC located below the pan forming the bottom of the hopper 10, over which the upper flights of the feed conveyors 12, 14 ride as they pass through the conveyor 10. The load cells LC measure the rate of the material in each half of the hopper 10. When the amount of material drops below a predetermined level on one side of the hopper, it generates a signal which leads to a speed control (FIG. 12) for the drive system of the vehicle, causing such vehicle to slow down. By way of typical and therefore non-limitive example, the vehicle may be driven by a hydraulic motor of the type described and the sensor LC may control a flow valve of the type described to slow down the motor. When the operator feels the vehicle slowing down he knows that it is time to signal for more paving material PM. The use of some sort of means for measuring the quantity of material in each half of the hopper 10, and then slowing the machine down when the amount of material drops below a predetermined amount, makes it possible for the machine to continue to move forwardly while the operator signals for more paving material PM, and makes it possible for such additional paving material PM to be received and deposited into the hopper 10 before any thinning out of the tunnel occurs.

Figure 13:
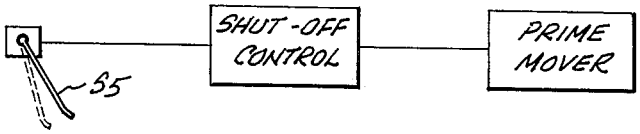
FIG. 13 is a block diagram of a shut-off system for the machine advance mechanism, responsive to a decrease in the level of material in the tunnel region of the machine.

In addition to or in place of the load cell system the paving machine may be provided with a sensor S5, S6 above each feed conveyor 12, 14, immediately downstream of the metering opening 18. Each such sensor may be used for detecting a drop in the depth of material on its feed conveyor 12, 14, indicating a malfunction in the feed process or an emptying of the hopper. A drop in depth sensed by one of the sensor will be used to send a signal to a shut off control (FIG. 13) that will stop forward advancement of the machine.

It may be necessary or desirable to change the height of opening 18 while adapting the machine for a particular job. However, as previously mentioned, while practicing my invention the height of opening 18 is not changed for the purpose of changing the feed rate of the paving material PM.

What is claimed is:

1. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a fixed height opening at the hopper to control the amount of paving material that is delivered from the hopper onto each feed conveyor;

a separate variable speed drive means for each feed conveyor, each of which is operatively connected to its feed conveyor;

control means for the feed conveyor drive means, including a separate sensor for each feed conveyor, each of which is mounted on the paving machine adjacent the discharge end of its feed conveyor and at the inboard end of the associated auger, for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated feed conveyor as the level drops and proportionally and substantially instantaneously decreasing the drive speed of such feed conveyor as the level rises;

a separate variable speed drive means for each auger, each of which is operatively connected to its feed conveyor; and control means for the auger drive means, including a separate sensor for each auger, each of which is mounted on the paving machine adjacent the outboard end of its auger for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated auger as the level drops and proportionally and substantially instantaneously decreasing the drive speed of such auger as the level rises, whereby the feed conveyors and the augers are continuously being independently and automatically driven at speeds proportional to the demand for paving material at the discharge ends thereof.

2. The improvement of claim 1, wherein the variable speed drive means for the feed conveyors comprises a separate flow controlled variable speed hydraulic motor for each feed conveyor, each said motor including a motive fluid delivery line leading into it, and wherein the control means for the feed conveyor drive means comprises a flow control valve in each said motive fluid delivery line, and a reversible electric servo motor actuator operatively connected to such flow control valve, for controlling it, and wherein the signal produced by each feed conveyor sensor proportionally actuates the electric servo motor actuator for the flow control valve in the motive fluid delivery line leading to the hydraulic motor for its feed conveyor, to in that manner proportionally change the flow of fluid to, and hence the drive speed of, the hydraulic motor, and in turn the delivery rate of the feed conveyor.

3. The improvement of claim 1, wherein the variable speed drive means for the augers comprises a separate flow controlled variable speed hydraulic motor for each auger, each said motor including a motive fluid delivery line leading into it, and wherein the control means for the auger drive means comprises a flow control valve in each said motive fluid delivery line, and a reversible electric servo motor actuator operatively connected to such flow control valve, for controlling it, and wherein the signal produced by each auger sensor proportionally actuates the electric servo motor actuator for the flow control valve in the motive fluid delivery line leading to the hydraulic motor for its auger, to in that manner proportionally change the flow of fluid to, and hence the drive speed of, the hydraulic motor, and in turn the delivery rate of the auger.

4. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a separate variable speed drive means for each feed conveyor, each of which is operatively connected to its feed conveyor;

control means for the feed conveyor drive means, including a separate sensor for each feed conveyor, each of which is mounted on the paving machine adjacent the discharge end of its feed conveyor, for measuring changes in the level of the paving material deposited onto the surface below the sensor and producing a signal proportional to said changes, and means operatively connected to said sensor which is responsive to the signal indicating changes in the level of the paving material at the sensor, for proportionally increasing the drive speed of the associated feed conveyor as the level drops and proportionally decreasing the drive speed of such feed conveyor as the level rises;

a separate variable speed drive means for each auger, each of which is operatively connected to its feed conveyor;

control means for the auger drive means, including a separate sensor for each auger, each of which is mounted on the paving machine adjacent to the outboard end of its auger for measuring changes in the level of the paving material deposited onto the surface below the sensor and producing a signal proportional to said changes, and means operatively connected to said sensor which is responsive to the signal indicating changes in the level of the paving material at the sensor, for proportionally increasing the drive speed of the associated auger as the level drops and proportionally decreasing the drive speed of such auger as the level rises, whereby the feed conveyors and the augers are continuously being independently and automatically driven at speeds proportional to the demand for paving material at the discharge ends thereof; and means operatively mounted on said machine for sensing and producing a signal proportional to the amount of paving material in the hopper and means responsive to said signal for controlling the advance of the paving machine when the amount of material in the hopper drops below a predetermined amount, to in that manner signal the machine operator of such condition.

5. The improvement of claim 4, wherein the sensing means comprises a pair of load sensors, one associated with each feed conveyor within the hopper, for measuring the weight of paving material on the feed conveyor within the hopper.

6. The improvement of claim 4, wherein the control means slows down the advance speed of the paving machine when the amount of paving material in the hopper drops below a predetermined amount.

7. The improvement of claim 4, wherein the control means stops the paving machine when the amount of paving material in the hopper drops below a predetermined amount.

8. A method of operating a paving machine of a type having a pair of endless feed conveyors arranged to deliver paving material rearwardly from a hopper to the inboard portions of a pair of transverse augers which serve to spread the material outwardly and deposit it onto the surface being paved forwardly of a screed which trails the augers, said method comprising:

using a fixed height opening at the hopper to control the amount of paving material that is delivered from the hopper onto each feed conveyor;

separately driving each feed conveyor by a variable speed drive means;

measuring the level of the paving material being deposited into each auger in the region between the discharge end of each feed conveyor and the inboard portion of its auger;

proportionally and substantially instantaneously changing the drive speed of each feed conveyor in response to changes in the sensed level of the paving material that is deposited into the auger associated with such feed conveyor, including proportionally and substantially instantaneously increasing the drive speed of the associated feed conveyor as the level drops and proportionally and substantially instantaneously decreasing the drive speed of such feed conveyor as the level rises;

separately driving each auger by a separate variable speed drive means for each auger;

measuring the level of paving material delivered to the outboard region of each auger and proportionally and substantially instantaneously controlling the auger drive means in response to changes in such level, including proportionally and substantially instantaneously increasing the drive speed of each auger as the level of paving material at the end of such auger drops and proportionally and substantially instantaneously decreasing the drive speed of such auger as the level of paving material rises;

extending an extendable portion of the screed laterally outwardly from the screed proper in order to widen the mat of paving material; and measuring the level of paving material in the region of the extended portion of the screed to proportionally control the drive means for the corresponding auger, so that promptly following extension of the screed the drive speed of the auger will automatically increase and paving material will be brought into the region covered by the extended portion of the screed.

9. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a separate variable speed drive means for each feed conveyor, each of which is operatively connected to its feed conveyor;

control means for the feed conveyor drive means, including a separate sensor for each feed conveyor, each of which is mounted on the paving machine adjacent the discharge end of its feed conveyor, for measuring changes in the level of the paving material deposited onto the surface below the sensor and producing a signal proportional to said changes, and means operatively connected to said sensor which is responsive to the signal indicating changes in the level of the paving material at the sensor, for proportionally increasing the drive speed of the associated feed conveyor as the level drops and proportionally decreasing the drive speed of such feed conveyor as the level rises;

a separate variable speed drive means for each auger, each of which is operatively connected to its feed conveyor;

control means for the auger drive means, including a separate sensor for each auger, each of which is mounted on the paving machine adjacent the outboard end of its auger for measuring changes in the level of the paving material deposited onto the surface below the sensor and producing a signal proportional to said changes, and means operatively connected to said sensor which is responsive to the signal indicating changes in the level of the paving material at the sensor, for proportionally increasing the drive speed of the associated auger as the level drops and proportionally decreasing the drive speed of such auger as the level rises, whereby the feed conveyors and the augers are continuously being independently and automatically driven at speeds proportional to the demand for paving material at the discharge ends thereof;

a screed extender mounted on at least one side of said paving machine;

means on said paving machine operatively connected to said screed extender, for extending and retracting it; and with the level sensor for the spreader auger on the screed side of said machine being mounted on said machine to move outwardly with the screed extender, so that promptly following extension of the screed extender the drive speed of the associated auger will automatically increase and paving material will be brought into the region covered by the extended screed extender.

10. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a separate variable speed, flow controlled hydraulic drive motor for each auger, each said motor being operatively connected to its auger and including a motive fluid delivery line leading to it;

control means for the auger drive motors, including a separate sensor for each auger, each of which is mounted on the paving machine adjacent the outboard end of its auger, for measuring changes in the level of the paving material deposited onto the surface below the sensor and producing a signal proportional to said changes, and flow control valve means in each motive fluid delivery line, including control means responsive to the signal indicating changes in the level of the paving material at the sensor, for controlling said flow control valve means to proportionally increase the drive speed of the associated auger motor, and hence the auger itself, as the level drops, and proportionally decrease the drive speed of such auger motor, and hence the auger itself, as the level rises;

a screed extender mounted on at least one side of the paving machine;

means on said paving machine operatively connected to said screed extender, for extending and retracting it; and with the level sensor for the spreader auger on that side being mounted on said machine to move outwardly with the screed extender, so that promptly following extension of the screed extender the drive speed of the associated auger will automatically increase and paving material will be brought into the region covered by the extended screed extender.

* * * * *